US006871950B2

(12) United States Patent
Higuma et al.

(10) Patent No.: US 6,871,950 B2
(45) **Date of Patent: *Mar. 29, 2005**

(54) IMAGE-TRANSFER MEDIUM, PRODUCTION PROCESS OF TRANSFERRED IMAGE, AND CLOTH WITH TRANSFERRED IMAGE FORMED THEREON

(75) Inventors: Masahiko Higuma, Togane (JP); Yuko Sato, Kawasaki (JP); Yoshiyuki Shino, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/248,271

(22) Filed: Feb. 11, 1999

(65) Prior Publication Data

US 2003/0165643 A1 Sep. 4, 2003

(30) Foreign Application Priority Data

Feb. 13, 1998 (JP) ..... 10-031713

(51) Int. Cl.[7] ..... B41M 5/00

(52) U.S. Cl. ..... 347/105; 428/32.12; 428/32.17; 428/32.34

(58) Field of Search ..... 347/105; 428/32.12, 428/32.17, 32.34, 195, 327, 328

(56) References Cited

U.S. PATENT DOCUMENTS

| | | | | |
|---|---|---|---|---|
| 4,785,313 | A | 11/1988 | Higuma et al. | 346/135.1 |
| 5,501,902 | A | 3/1996 | Kronzer | 428/323 |

FOREIGN PATENT DOCUMENTS

| | | |
|---|---|---|
| JP | 8-207426 | 8/1996 |
| JP | 8-207450 | 8/1996 |
| JP | 10-16382 | 1/1998 |

*Primary Examiner*—Pamela R. Schwartz
(74) *Attorney, Agent, or Firm*—Fitzpatrick, Cella, Harper & Scinto

(57) ABSTRACT

Disclosed herein is an image-transfer medium, comprising an ink vehicle-absorbing layer, which is subjected to a release treatment, and coloring material-retaining layer.

6 Claims, No Drawings

IMAGE-TRANSFER MEDIUM, PRODUCTION PROCESS OF TRANSFERRED IMAGE, AND CLOTH WITH TRANSFERRED IMAGE FORMED THEREON

BACKGROUND OF THE INVENTION

1. Field of the Invention

The present invention relates to an image-transfer medium suitable for use in forming an image on a transfer-printing medium by transfer printing, a process for producing a transferred image using this image-transfer medium, and a cloth with a transferred image formed thereon, and more particularly to an image-transfer medium suitable for use in an ink-jet recording method using, particularly, water-based inks upon forming an image on a coloring material-retaining layer making up the image-transfer medium, a process for producing a transferred image by using such an image-transfer medium by transferring the coloring material-retaining layer having an image thereon to a transfer-printing medium, thereby forming the transferred image, and a cloth with a transferred image formed thereon by the production process.

2. Related Background Art

As typical ink-jet printing systems using water-based inks, various ink ejection systems are known, for example, an electrostatic attraction system, a system in which a piezoelectric element is used to give an ink mechanical vibration or change, and a system in which an ink is heated to form bubbles in the ink, thereby using the pressure thus produced. The printing is conducted by, generating and ejecting minute droplets of an ink by one of these ink ejection systems and applying parts or all of the droplets to a recording medium. Such an ink-jet printing system attracts attention as a simple system which produces minimal noise and can conduct high-speed printing and color printing. In recent years, ink-jet printers making good use of such a system, by which color printing can be simply conducted, have become widespread.

In recent years, there also has been an increasing demand for conducting color printing on various recording media using these printers. In order to meet such a demand, particular attention is paid to printing techniques in which an image is formed on an image-transfer medium (image-transfer paper) by an ink-jet printing system, and the image is then transfer-printed on another transfer-printing medium so that printing can be conducted irrespective of the form of transfer-printing media, namely, the formation of an image can be performed on any medium which does not permit direct printing by a printer.

Some image-transfer media making good use of an ink-jet printing system to form an image thereon have been proposed to date. Japanese Patent Application Laid-Open No. 8-207426 has proposed an ink-jet printing sheet in which an ink-receiving layer is composed of a thermoplastic resin, a crystalline plasticizer and a tackifier, thereby permitting sticking a transferred image to a transfer-printing medium by heating alone. Japanese Patent Application Laid-Open No. 8-207450 has proposed an image-transfer medium in the form of a sheet, comprising a base material layer and a heat transfer layer which is composed of a particulate thermoplastic resin, inorganic porous fine particles and a binder and permits ink-jet printing and heat transfer printing. U.S. Pat. No. 5,501,902 has proposed an image-transfer medium for ink-jet, comprising a transfer layer of a structure that a cationic resin, an ink-viscosity adjuster and the like are added in addition to the above-described components.

However, these image-transfer media according to the prior art have not been able to satisfy suitability for ink-jet printing, simplification of transfer printing, fastness properties of images transfer-printed on transfer-printing media, and the like at the same time. Therefore, in Japanese Patent Application Laid-Open No. 10-16382, the present inventors proposed an image-transfer medium comprising a base material, a releasing layer and a transfer layer.

The image-transfer medium described above has been well balanced among the suitability for ink-jet printing, simplification of transfer printing and fastness properties of the transferred image. When an image printed on the image-transfer medium is transfer-printed on a flexible transfer-printing medium, for example, a cloth or paper, however, such an image-transfer medium has not been said to be satisfactory in point of forming a high-quality transferred image without impairing the hand and touch inherent in the transfer-printing medium at the portion on which the transferred image has been formed. In particular, this tendency has become more pronounced when the image-transfer medium is used in a high-image quality color printer, since the transfer layer must be thickened due to increased shot-in ink quantity. In addition, although this image-transfer medium is excellent in point of the simplification of formation of a transferred image, because it has a releasing layer, and so a base material can be removed with ease after transfer printing, it takes a long time to transfer the transfer layer great in thickness like the above-described case in the case where transfer printing is conducted with the image-transfer medium of large size by means of a household iron or the like. Therefore, the image-transfer medium has not been said to be satisfactory also with respect to everyone being able to form a transferred image of large size in good condition.

SUMMARY OF THE INVENTION

It is an object of the present invention to provide an image-transfer medium by which a high-density and high-quality transferred image can be simply formed when an image formed with inks on the image-transfer medium is transfer-printed on a transfer-printing medium such as a cloth to form a transferred image on the transfer-printing medium, and moreover the transfer printing process can be conducted in a home or the like with greater ease than the conventional image-transfer media, a production process of a transferred image using this image-transfer medium, and a cloth with a transferred image formed thereon by the production process.

Another object of the present invention is to provide an image-transfer medium which has excellent suitability for ink-jet printing using water-based inks for the purpose of permitting the formation of a high-density and high-quality image with the water-based inks and particularly brings about an excellent effect on the maintenance of hand inherent in a transfer-printing medium such as a cloth when the image formed with the water-based inks is transfer-printed on the transfer-printing medium, a production process of a transferred image using this image-transfer medium, and a cloth with a transferred image formed thereon by the production process.

The above objects can be achieved by the present invention described below.

According to the present invention, there is thus provided an image-transfer medium, comprising an ink vehicle-absorbing layer and a coloring material-retaining layer, and being so constituted that the two layers are releasable from each other.

According to the present invention, there is also provided a process for producing a transferred image, comprising the steps of forming an image on the coloring material-retaining layer of the image-transfer medium described above in accordance with an ink-jet printing system; and overlapping the image-transfer medium, on which the image has been formed, and a transfer-printing medium on each other to transfer the coloring material-retaining layer to the transfer-printing medium.

According to the present invention, there is further provided a cloth with a transferred image formed thereon by the production process described above.

DETAILED DESCRIPTION OF THE PREFERRED EMBODIMENTS

The present invention will hereinafter be described in detail with reference to the preferred embodiments of the invention.

The present inventors have carried out an extensive investigation with a view toward solving the above-described problems involved in the prior art. As a result, it has been found that when an image-transfer medium is provided as a two-layer structure of a coloring material-retaining layer for holding a coloring material in an ink when the ink is applied to form an image, and an ink vehicle-absorbing layer provided on the underside of the coloring material-retaining layer for absorbing a liquid medium in the ink, and is so constructed that the ink vehicle-absorbing layer and the coloring material-retaining layer may be successfully released and separated from each other after transfer printing, only a coloring material in, for example, a water-based ink is captured in the coloring material-retaining layer when an image is formed on the image-transfer medium with the water-based ink, and on the other hand, a liquid medium component dissolving or dispersing the coloring material therein promptly migrates into the ink vehicle-absorbing layer, so that a high-optical density and high-quality image can be formed on the coloring material-retaining layer, and moreover only the coloring material-retaining layer, on which only the coloring material has been held, can be transferred to a transfer-printing medium because the ink vehicle-absorbing layer is easily released and removed from the coloring material-retaining layer after transfer printing, so that hand and softness inherent in the transfer-printing medium such as a cloth are not impaired when a transferred image is formed thereon, thus leading to completion of the present invention.

The image-transfer medium according to the present invention comprises an ink vehicle-absorbing layer and a coloring material-retaining layer for holding a coloring material in an ink. The ink vehicle-absorbing layer will be first described.

Such an ink vehicle-absorbing layer may be any layer so far as, for example, in the case where a water-based ink is applied to the image-transfer medium by a recording apparatus for water-based inks to form an image thereon, it has the ability to absorb liquid medium components, such as water and organic solvents, in the ink applied as rapidly as possible and hold them in the layer (this ability is hereinafter referred to as "ink vehicle absorbing ability"). More specifically, as described below, the ink vehicle-absorbing layer may be provided on a base material, or the ink vehicle-absorbing layer itself may be formed in the form of a sheet-or film without using any base material in such a manner that it has both the ink absorbing ability and the function as a support for carrying the coloring material-retaining layer.

In order to develop the ink absorbing ability upon the formation of the ink vehicle-absorbing layer having such function as described above in the present invention, for example, the following mode (a) or (b), and a combination of the modes (a) and (b) are mentioned.

(a) The layer is mainly formed with a material which can satisfactorily absorb a vehicle (which means liquid medium components such as water and solvents in the case of the present invention) contained in an ink.

(b) Physical voids are defined in the ink vehicle-absorbing layer so as to absorb the vehicle therein as rapidly as possible and to hold it.

In order to form the ink vehicle-absorbing layer satisfying the mode (a), a material capable of satisfactorily absorbing the vehicle in the ink is required. As such materials, the conventionally-known water-soluble resins and water-swellable resins may be used. As a method for forming the ink vehicle-absorbing layer of the image-transfer medium according to the present invention, there may be used, for example, a method in which these materials are used as a main component to form a sheet or film in accordance with the conventionally-known technique, and the sheet or film is used as the ink vehicle-absorbing layer combined with the function as a support for the coloring material-retaining layer, or a method in which a water-soluble resin or water-swellable resin is applied to a base material in the form of a sheet or film, which is composed of a material described below, by the conventionally-known technique to form the ink vehicle-absorbing layer.

Even when voids capable of holding the vehicle therein are defined in an ink vehicle-absorbing layer to provide it as the ink vehicle-absorbing layer of mode (b), such conventionally-known materials and techniques as described below may be used. For example, methods for forming porous layers composed mainly of pigment particles and a binder, porous sheets, such as filter paper and a support of coated paper for ink-jet, composed mainly of a fibrous material and a binder, and porous sheets such as paper comprising a filler and synthetic paper may be preferably used in the present invention. Methods for forming a sheet called a nonwoven fabric may also be preferably used in the present invention.

When such an ink vehicle-absorbing layer as described above is formed, it is preferred in the case where the ink vehicle-absorbing layer itself does not develop the function as a support for the coloring material-retaining layer that a base material be separately provided to form the ink vehicle-absorbing layer with such a material as described above on at least one side of the base material. As the base material usable in that case, any base material may be used so far as it can be conveyed in printers without any trouble and has sufficient heat resistance to withstand heat transfer printing. Specific examples thereof include films and sheets of plastics such as polyester, diacetate, triacetate, acrylic polymers, polycarbonate, polyvinyl chloride, polyimide, cellophane and celluloid, and sheets such as paper, fabrics and nonwoven fabrics. In this case, it is preferred to use a flexible base material because even when the surface of a transfer-printing medium to be transfer-printed is curved, the image-transfer medium can be fitted to the shape of the transfer-printing medium, so that a good transferred image can be formed even on a transfer-printing medium other than a flat medium.

In the case where the base material is used upon the formation of the ink vehicle-absorbing layer, it is preferred that the surface (on which the ink vehicle-absorbing layer will be formed) of the base material be subjected to a chemical treatment with an anchoring agent or the like, or a physical treatment by UV irradiation or the like, because its adhesion property to the ink vehicle-absorbing layer can be enhanced. In the present invention, it is preferred that the image-transfer medium be constructed in such a manner that the adhesion property between the base material and the ink vehicle-absorbing layer becomes greater than the adhesion property between the coloring material-retaining layer provided on the ink vehicle-absorbing layer and the ink vehicle-absorbing layer, because the ink vehicle-absorbing layer and the coloring material-retaining layer must be able to be easily released and separated from each other after transfer printing as described below. Incidentally, the coloring material-retaining layer making up the image-transfer medium according to the present invention will be described subsequently.

In the image-transfer medium according to the present invention, the coloring material-retaining layer is formed on the ink vehicle-absorbing layer having high ink vehicle absorbing ability formed in the above-described manner. In the present invention, it is necessary for the ink vehicle-absorbing layer to be easily released from the coloring material-retaining layer after the coloring material-retaining layer is transferred to a transfer-printing medium by applying external energy such as heat or pressure.

A release treatment for the ink vehicle-absorbing layer, which can be used in the present invention, will hereinafter be described. In order to make the ink vehicle-absorbing layer easily releasable from the coloring material-retaining layer formed on the ink vehicle-absorbing layer after transfer printing without lowering the ink vehicle absorbing ability of the ink vehicle-absorbing layer, a releasing agent may be used to form a releasable ink vehicle-absorbing layer. However, it is preferred in the present invention that the following mode (1) or (2), or a combination of modes (1) and (2) be used to provide a separating layer, for easily releasing the ink vehicle-absorbing layer from the coloring material-retaining layer after transfer printing, between the two layers.

Mode (1): The above-described ink vehicle-absorbing layer is coated and impregnated with a solution of an oil- or solvent-type releasing agent to form a separating layer.

Mode (2): A dispersion in which a releasing agent of an emulsion-, compound- or fine particle-type is dispersed with its form retained is applied to the ink vehicle-absorbing layer to laminate a separating layer thereon.

These modes are also applied to the release treatment of general release paper. In the conventional release treatment, however, a stopping treatment is performed in advance to the surface of the base paper on which the parting function is developed, and there is no layer corresponding to the ink vehicle-absorbing layer which is an essential constitutional requirement for the image-transfer medium according to the present invention. In the present invention, it is important that the release treatment is conducted so as not to lower the ink vehicle absorbing ability of the ink vehicle-absorbing layer, whereby the ink vehicle-absorbing layer is made easily releasable from the coloring material-retaining layer. In the present invention, the absorption coefficient Ka of the ink vehicle-absorbing layer subjected to the release treatment on the side subjected to the release treatment is preferably not less than 1. The absorption coefficient Ka is determined by using a black ink having the following composition in accordance with the Bristow method (Paper and Pulp Testing Method No. 51 described in J. TAPPI).

| | |
|---|---|
| C.I. Direct Black 195 | 2 parts by weight |
| Acetylenol EH (trade name, product of Kawaken Fine Chemicals Co., Ltd.) | 1 part by weight |
| Glycol | 5 parts by weight |
| Diethylene glycol | 4 parts by weight |
| Urea | 5 parts by weight |
| Isopropyl alcohol | 2 parts by weight |
| Water | 81 parts by weight. |

In the release treatment of mode (1) described above, the releasing agent used is in the 0.25 form of a uniform liquid. Therefore, even when the ink vehicle-absorbing layer is an ink vehicle-absorbing layer having a porous structure according to mode (b) of the ink vehicle-absorbing layer described above, the releasing agent can be applied to the ink vehicle-absorbing layer without blocking up voids in the ink vehicle-absorbing layer when the release treatment is subjected to the ink vehicle-absorbing layer by this method. It is hence preferred to use such a releasing agent, because the high ink vehicle absorbing ability of the ink vehicle-absorbing layer according to the above-described mode is not impeded.

However, when the ink vehicle-absorbing layer has the above-described porous structure, the amount of the releasing agent used in the treatment must be increased to at least twice as much as the amount used in the conventional treatment conducted for release paper and the like, though it varies according to the mode of the ink vehicle-absorbing layer used, in order to develop the parting function from the coloring material-retaining layer on the ink vehicle-absorbing layer without lowering the function of the ink vehicle-absorbing layer. In general, it is preferably not less than 1 $g/m^2$ (in terms of solids). However, the upper limit of the amount used in the treatment must be determined in view of the influence on the ink vehicle-absorbing layer used.

In the separating layer of mode (2), the releasing agent remains in the form of fine solid particles when conducting the release treatment. Therefore, a porous separating layer containing the releasing agent is formed on the ink vehicle-absorbing layer. It is hence preferred to use such a releasing agent, because the ink vehicle absorbing ability of the ink vehicle-absorbing layer is not impeded when the release treatment is conducted. The release treatment method according to mode (2) may preferably be applied to either ink vehicle-absorbing layer of the above-described modes (a) and (b).

In the image-transfer medium according to the present invention, the coating weight of the releasing agent preferably falls within a range of from 1 to 30 $g/m^2$ in order to effectively develop the releasing function of the ink vehicle-absorbing layer from the coloring material-retaining layer after transfer printing without lowering the ink vehicle absorbing ability of the ink vehicle-absorbing layer. The more preferable range is from 1 to 20 $g/M^2$, most preferably from 2 to 15 $g/m^2$.

When the separating layer for easily releasing the ink vehicle-absorbing layer from the coloring material-retaining layer after transfer printing is provided between both layers in the present invention, it is preferred that when a releasing agent of the emulsion-, compound- or fine particle-type is used like the above-described mode (2), the conventionally-known water-soluble resin, water-swellable resin or thermoplastic resin be used as a binder for the releasing agent. Even in this case, as described above, the binder must be used within limits not impeding the ink vehicle absorbing ability of the ink vehicle-absorbing layer.

Examples of a specific material of the releasing agent contained in the ink vehicle-absorbing layer or the releasing agent used in the separating layer formed on the ink vehicle-absorbing layer include waxes such as carnauba wax, paraffin wax, microcrystalline wax and castor wax; higher fatty acids and derivatives thereof such as metal salts and esters, for example, stearic acid, palmitic acid, lauric acid, aluminum stearate, lead stearate, barium stearate, zinc stearate, zinc palmitate, methyl hydroxystearate and glycerol monohydroxystearate; polyamide resins; petroleum resins; rosin derivatives; coumarone-indene resins; terpene resins; novolak resins; styrene resins; olefin resins such as polyethylene, polypropylene, polybutene and polyolefin oxides; and vinyl ether resins. Besides, silicone resins, fluorosilicone resins, fluoroolefin-vinyl ether terpolymers, perfluoroepoxy resins, thermosetting acrylic resins having perfluoroalkyl groups at their side chains, Teflon resins, and vinylidene fluoride type hardening resins may also be mentioned. These materials may be used either singly or in any combination thereof.

The coloring material-retaining layer making up the image-transfer medium according to the present invention together with the ink vehicle-absorbing layer will now be described. Such a coloring material-retaining layer is provided on the ink vehicle-absorbing layer and may be any layer so far as it is so constructed that it can capture and hold a coloring material in an ink, and the ink vehicle-absorbing layer is released and separated from the coloring material-retaining layer after transfer printing to mainly transfer the coloring material-retaining layer to a transfer-printing medium to form an image. More specifically, it is preferred that the coloring material-retaining layer making up the image-transfer medium according to the present invention can capture and hold coloring materials (dyes and/or pigments) in inks used upon the formation of an image on the resulting image-transfer medium by means of, for example, a recording apparatus for water-based inks such as an ink-jet recording apparatus as much as possible without being affected by such inks. It is also preferred that the coloring material-retaining layer be constructed in such a manner that liquid components such as water and organic solvents other than a coloring material, which are components of an ink, are rapidly introduced into the ink vehicle-absorbing layer provided under the coloring material-retaining layer. It is further preferred that the coloring material-retaining layer be formed with a material which is easily melted by heating upon heat transfer printing to satisfactorily adhere to a transfer-printing medium, and be so constructed that it is easily released from the ink vehicle-absorbing layer after the transfer printing, whereby the coloring material-retaining layer is mainly transferred to the transfer-printing medium.

Since such a coloring material-retaining layer is transferred to the surface of a transfer-printing medium in a state that an image has been formed in the layer to put it to practical use, it is preferably formed with a material which withstands washing and rubbing to provide a transferred image having excellent fastness properties. In addition, it is preferred that the coloring material-retaining layer is so constructed that when a transferred image is formed on a transfer-printing medium such as a cloth by the coloring material-retaining layer, the soft hand inherent in the transfer-printing medium is not impaired at the portion on which the transferred image has been formed.

As a preferred mode of the coloring material-retaining layer satisfying the various requirements mentioned above, it is preferred that, for example, the coloring material-retaining layer be composed mainly of a thermoplastic resin so as to have a porous structure by which the surface of the coloring material-retaining layer, to which an ink is applied, is permeably communicated with the ink vehicle-absorbing layer. When a dye ink is used for the formation of an image, it is preferred that a resin having an ionicity opposite to that of the dye used be contained in the coloring material-retaining layer in order that the dye may be surely captured and firmly held in the coloring material-retaining layer. When a pigment ink is used on the other hand, it is preferred that the coloring material-retaining layer be so constructed that the porous structure of the coloring material-retaining layer has a pore diameter smaller than the particle diameter of the pigment used to capture and hold only the pigment as a coloring material on the coloring material-retaining layer. As a mode for capturing a coloring material in an ink in or on the coloring material-retaining layer as much as possible, for example, it is only necessary to form the coloring material-retaining layer in the same manner as in the formation of a coloring material-retaining layer (transfer layer) of the conventionally-known thermal image-transfer medium for ink-jet.

As with the case of the ink vehicle-absorbing layer described above, even in the coloring material-retaining layer making up the image-transfer medium according to the present invention, silicone, wax, resin or the like may be contained therein within limits not impeding the function of the coloring material-retaining layer in order to improve the release property of the coloring material-retaining layer from the ink vehicle-absorbing layer. As specific materials used in this case, may be mentioned the same materials as the releasing agents described above.

As the thermoplastic resin used as a material for forming the coloring material-retaining layer making up the image-transfer medium according to the present invention, any thermoplastic resin may be used so far as it is a water-insoluble thermoplastic resin. Examples of such a thermoplastic resin include polyethylene, polypropylene, polyethylene oxide, polyvinyl acetate, polyvinyl alcohol, polyvinyl acetal, poly(meth)acrylic acid, poly(meth)acrylates, polyacrylic acid derivatives, polyacrylamide, polyether, polyester, polycarbonate, cellulosic resins, polyacrylonitrile, polyimide, polyamide, polyvinyl chloride, polyvinylidene chloride, polystyrene, Thiokol, polysulfone, polyurethane, and copolymers and modified products of these resins. Of these, polyethylene, polypropylene, polyethylene oxide, poly(meth)acrylic acid, poly(meth)acrylates, polyvinyl acetate, polyvinyl chloride, polyurethane, polyamide, and copolymers and modified products thereof are more preferably used.

The thermoplastic resin used in the formation of the coloring material-retaining layer in the present invention is preferably in the form of fine particles. In this case, it is preferred to contain the fine particles of the thermoplastic resin, a binder for forming a film, and a crosslinking agent for crosslinking the fine particles of the thermoplastic resin and/or a resin constituting the binder upon transfer printing in the coloring material-retaining layer formed. According to such a mode, the coloring material is captured and held efficiently and sufficiently, so that not only a high-quality image having a high optical density can be formed, but also a firm transferred image is effectively formed when the coloring material-retaining layer is transferred to a transfer-printing medium to form the transferred image.

As the fine particles of the thermoplastic resin used in the present invention, it is preferred to use those formed of a material which permits forming an image on the resulting coloring material-retaining layer by means of a general-purpose ink-jet printer and thereafter simply transferring the coloring material-retaining layer, on which the image has been formed, in a home or the like. Taking this factor into consideration, the thermoplastic resin used preferably has a melting point ranging from 70° C. to 200° C., more preferably from 80° C. to 180° C., most preferably from 100° C. to 150° C. If a thermoplastic resin having a melting point lower than 70° C. is used, the fine particles of the thermoplastic resin in the resulting coloring material-retaining layer may possibly be melted to form a continuous film according to conditions where the resulting image-transfer medium is shipped or stored. After coating the base material with the fine particles of the thermoplastic resin, it is necessary to dry the coating layer at a temperature lower than the melting point of the fine particles of the thermoplastic resin. It is thus preferred to use the thermoplastic resin having a melting point of at least 70° C. even from the viewpoint of production efficiency. On the other hand, if a resin having a melting point higher than 200° C. is used, higher energy is required for the transfer printing of an image formed on the resulting coloring material-retaining layer on a transfer-printing medium. It is hence difficult to simply form a transferred image on the transfer-printing medium such as a cloth, which is an object of the present invention.

The particle size of the fine particles of the thermoplastic resin used in the present invention is preferably within a range of from 0.05 to 100 μm, more preferably from 0.2 to 50 μm, most preferably from 5 to 20 μm from the viewpoints of the ink absorbency of the resulting coloring material-retaining layer and the clearness of the resulting image. If the particle size of the fine particles of the thermoplastic resin is smaller than 0.05 μm, interparticle voids become too small when a coloring material-retaining layer is formed from such fine particles, so that the coloring material in an ink is not captured and held efficiently and sufficiently, and a satisfactory transferred image may not be provided in some cases. If the particle size is greater than 100 μm on the other hand, the resolution of the resulting image becomes low, so that it is difficult to provide a clear image.

As the fine particles of the thermoplastic resin, porous fine particles are preferably used. When the porous fine particles are used as a material for forming the coloring material-retaining layer, the specific surface area of the coloring material-retaining layer is increased to further enhance the ability to capture a coloring material in an ink in the coloring material-retaining layer, so that a greater amount of the ink can be held in a thinner layer to enhance the optical density of the resulting transferred image after transfer printing. Further, the provision of the thinner coloring material-retaining layer not only permits transferring the resulting image with greater ease, but also provides a more preferable image-transferred article having a soft hand without impairing the hand of a transfer-printing medium at the transfer-printed portion thereof when a flexible material such as a cloth is used as the transfer-printing medium in particular to form a transferred image on the surface of the cloth.

No particular limitation is imposed on the binder preferably used, together with the fine particles of the thermoplastic resin, as a material for forming the coloring material-retaining layer making up the image-transfer medium according to the present invention so far as it can bond the fine particles of the thermoplastic resin to one another and permits the formation of a coloring material-retaining layer in the form of a thin film. However, it is preferred to use the same water-insoluble thermoplastic resin as that used in the fine particles of the thermoplastic resin described above, or a cationically modified thermoplastic resin from the viewpoints of adhesion property to transfer-printing media and the ability to capture a coloring material in an ink in the coloring material-retaining layer, which will be described subsequently.

In the present invention, as described above, a crosslinking agent, which reacts with the fine particles of the thermoplastic resin and the binder or other materials in the coloring material-retaining layer, or a transfer-printing medium to form a crosslinked structure, is preferably used when the coloring material-retaining layer is formed. As the crosslinking agent, any conventionally-known crosslinking agent may be used so far as it has such a function as described above. For example, crosslinking agents, which can initiate a crosslinking reaction by applying energy such as heat or light, may be suitably used.

In the present invention, it is preferred to use a coloring material capturing agent in addition to the above-described components upon the formation of the coloring material-retaining layer in order to more efficiently capture a coloring material such as a dye or pigment in an ink. Since many of coloring materials used in inks for ink-jet are generally anionic, it is preferred to use a cationic material as the coloring material capturing agent.

Specific examples of the cationic material used in this case include the following materials:

cationically modified products of resins such as polyvinyl alcohol, hydroxyethyl cellulose and polyvinyl pyrrolidone;

polymers and copolymers of amine monomers such as allylamine, diallylamine, allyl sulfone, dimethylallyl sulfone and diallyldimethylammonium chloride, and of acrylic monomers having a primary, secondary or tertiary amine, or quaternary ammonium base at their side chains, such as dimethylaminoethyl (meth)acrylate, diethyl-aminoethyl (meth)acrylate, methylethylaminoethyl (meth)acrylate, dimethylaminostyrene, diethylaminostyrene, methylethylaminostyrene, N-methyiacrylamide, N,N-dimethyl-acrylamide, N,N-diethylaminoethyl methacrylamide and quaternized compounds thereof; and resins having a primary, secondary or tertiary amine, or quaternary ammonium base, such as dicyanamide, as their main chains.

When a coloring material used in an ink is a pigment, it is preferred to use inorganic particles as the coloring material capturing agent. As the inorganic particles used in the present invention, any conventionally-known inorganic particles may be used so far as they have a communicated porous structure capable of capturing the pigment in the ink and absorbing liquid components in the ink. However, inorganic particles having a pore diameter smaller than the particle diameter of the pigment contained in the ink are preferably used in the present invention. Specific examples thereof include silica, aluminum silicate, magnesium silicate, hydrotalcite, calcium carbonate, titanium oxide, clay, talc and (basic) magnesium carbonate. It is also preferred in a case of inorganic particles to use a material having a higher void volume. When such inorganic particles are used, the efficiency for capturing and holding the coloring material in the ink in the resulting coloring material-retaining layer is enhanced, and so a clearer image can be provided.

When the coloring material-retaining layer making up the image-transfer medium according to the present invention is formed, a mixing ratio of the fine particles of the thermoplastic resin to the binder used in the coloring material-retaining layer is preferably within a range of from 1/2 to 50/1, more preferably from 1/2 to 20/1, most preferably from 1/2 to 15/1. If the ratio is smaller than 1/2, the porosity of the coloring material-retaining layer is lowered, and the ink absorbency of the coloring material-retaining layer, in particular, right after conducting printing on the coloring material-retaining layer with water-based inks is hence lowered, so that the resolution of the resulting image becomes low, resulting in a failure to provide a high-quality image. If the ratio is greater than 50/1, adhesion among the fine particles of the thermoplastic resin or between the fine particles of the thermoplastic resin, and the ink vehicle-absorbing layer and separating layer becomes insufficient, which makes it impossible to form a coloring material-retaining layer having sufficient strength.

In the image-transfer medium according to the present invention, the constitution described above makes it possible to decrease the layer thickness of the coloring material-retaining layer as compared with the case of the conventionally-known image-transfer media, because in the image-transfer medium according to the present invention, the ink vehicle-absorbing layer provided under the coloring material-retaining layer has high ink vehicle absorbing ability to accommodate a liquid component which is an ink vehicle, so that there is no need to accommodate all the components in inks applied in a transfer layer alone like the conventional image-transfer media.

In the present invention, it is preferred that the thickness of the coloring material-retaining layer be as thin as possible from the viewpoints of simplification of transfer printing, improved maintenance of hand inherent in transfer-printing media, and the like. However, the thickness is preferably within a range of from 5 to 130 μm, more preferably from 10 to 110 μm, most preferably from 15 to 100 μm taking the ability to capture a coloring material in the coloring material-retaining layer and improved fastness properties of the resulting transferred image into further consideration.

Examples of processes for forming the above-described ink vehicle-absorbing layer and coloring material-retaining layer and/or the separating layer, which make up the image-transfer media according to the present invention, include a process in which suitable materials mentioned above are dissolved or dispersed in a proper solvent to prepare a coating formulation, and the coating formulation is applied to a base material, a process in which films are formed from suitable materials, and the films are laminated on a base material or each other, and a process in which the suitable materials are extruded in the form of a film on a base material. Examples of a coating method of the coating formulation include roll coater, blade coater, air knife coater, gate roll coater, bar coater, size pressing, Symsizer, spray coating, gravure coating and curtain coater methods.

When the ink vehicle-absorbing layer and coloring material-retaining layer and the optionally formed separating layer, which make up the image-transfer media according to the present invention, are formed, as other additives than the above-described materials, may be suitably added the above-described crosslinking agent and a catalyst therefor, a pigment dispersant, a flowability modifier, an antifoaming agent, a foaming agent, a penetrant, a colorant, an optical whitening agent, an ultraviolet absorbent, an antioxidant, an antiseptic, a mildewproofing agent, a plasticizer, etc.

In order to enhance the transferability of the coloring material-retaining layer, it is preferred to incorporate a plasticizer most suitable for the fine particles of the thermoplastic resin preferred as a material for forming the coloring material-retaining layer. As the plasticizer used in this case, may be used any conventionally-known plasticizer. Specific examples thereof include phthalates such as diethyl phthalate, dioctyl phthalate, dimethyl phthalate and dibutyl phthalate, phosphates such as tributyl phosphate and triphenyl phosphate, adipates such as octyl adipate and isononyl adipate, sebacates such as dibutyl sebacate and dioctyl sebacate, acetyltributyl citrate, acetyltriethyl citrate, dibutyl maleate, diethylhexyl maleate, dibutyl fumarate, trimellitic acid type plasticizers, polyester type plasticizers, epoxy type plasticizers, stearin type plasticizers, chlorinated paraffins, toluenesulfonamide and derivatives thereof, and 2-ethylhexyl p-hydroxybenzoate.

It is also preferred to incorporate a surfactant into the ink vehicle-absorbing layer, coloring material-retaining layer and separating layer for the purpose of improving the ink absorbency of the resulting image-transfer medium and the shelf stability upon physical distribution. As the surfactant used in this case, may be used any conventionally-known material. For example, carboxylic acid salts, sulfonic acid salts, salts of sulfates and salts of phosphates are mentioned as anionic surfactants; salts of aliphatic amines, aliphatic quaternary ammonium salts, benzalkonium salts, benzethonium chloride, pyridinium salts and imidazolinium salts as cationic surfactants; carboxybetaine type, aminocarboxylic acid salts, imidazolinium betaine and lecithin as amphoteric surfactants; and the ether, ether-ester, ester and nitrogen-containing type surfactants as nonionic surfactants. Besides, fluorine-containing surfactants and reactive surfactants may also be included. In the present invention, it is particularly preferred to use a nonionic surfactant or a fluorine-containing surfactant.

The image-transfer media according to the present invention produced by such a process as described above can be applied to the production process of a transferred image according to the present invention, which comprises the steps of forming an image on the coloring material-retaining layer of the image-transfer medium in accordance with an ink-jet printing system; and overlapping the image-transfer medium, on which the image has been formed, on a transfer-printing medium to transfer the coloring material-retaining layer to the transfer-printing medium. It goes without saying that an image may be formed with other inks than water-based inks to transfer-print the image on a transfer-printing medium.

More specifically, in the process for producing a transferred image of the present invention, an image is first formed on the coloring material-retaining layer-of the image-transfer medium according to the present invention by an ink-jet printing system. The image-transfer medium, on which the image has been formed, and a transfer-printing medium such as a cloth or film are then laid to overlap each other with the coloring material-retaining layer on the side of the transfer-printing medium to heat them from the side opposite to the coloring material-retaining layer of the image-transfer medium by an iron, heat transfer machine or the like, thereby transferring the coloring material-retaining layer to the surface of the transfer-printing medium. Finally, the ink vehicle-absorbing layer is released and separated from the coloring material-retaining layer to form a transferred image on the transfer-printing medium such as the cloth. As an ink-jet printer used in this case, any commercially available ink-jet printer may be employed as it is. Inks used in the image-forming step may also be commercially-available water-based inks commonly used in ink-jet printers. No particular limitation is imposed on coloring materials making up the inks used. For example, conventionally-known anionic coloring materials may be used.

No particular limitation is imposed on the transfer-printing medium used in forming an image-transferred article in the present invention. However, those having a porous structure, such as cloth and paper are preferred from the viewpoint of the adhesion property to the coloring material-retaining layer upon transfer printing. In the production process of an image-transferred article according to the present invention, as described above, an image is formed on the coloring material-retaining layer, and the image is transfer-printed on a transfer-printing medium such as a cloth to form the transferred image. Since this process is different from a process of directly printing an image on a cloth to form the image, it is thus unnecessary to specially change coloring materials according to the kinds of fiber materials or the like making up transfer-printing media. Accordingly, when a cloth is used as the transfer-printing medium to form a transferred image on the cloth in accordance with the production process of an image-transferred article as described above, a cloth with a satisfactory transferred image formed thereon can be provided by a simple process. No particular limitation is imposed on the cloth used in forming the transferred image in the present invention. Examples of the material making up the cloth include fibers of cotton, hemp, silk, wool, rayon, polyester, nylon, acrylic, acetate, triacetate and polyurethane, and blended fibers thereof. The cloths made up of these materials may be used in any forms of a woven fabric, a knitted fabric and a nonwoven fabric.

The present invention will hereinafter be described more specifically by the following Examples and Comparative Examples. Incidentally, all designations of "part" or "parts" and "%" as will be used in the following examples wean part or parts by weight and % by weight unless expressly noted.

EXAMPLE 1

In this example, coated paper for ink-jet (HR-101, trade name, product of Canon Inc.) having an ink-receiving layer on a substrate was used, and the ink-receiving layer was utilized as an ink vehicle-absorbing layer in this example. The ink vehicle-absorbing layer was subjected to a release treatment (about 1 g/m$^2$) using a releasing agent composed of silicone TPR6712, trade name, and catalyst CM670, trade name (both, products of Toshiba Silicone Co., Ltd.) to form a separating layer. The absorption coefficient Ka of the ink vehicle-absorbing layer, on which the separating layer had been formed, was 55.

A coating formulation for a coloring material-retaining layer (Coating Formulation 1) having the following composition was then applied by a Meyer bar to the surface of the ink vehicle-absorbing layer, on which the separating layer had been formed by the release treatment. Thereafter, the coating formulation thus-applied was dried in an oven preset at 80° C. to form a coloring material-retaining layer having a thickness of about 40 μm, thereby obtaining an image-transfer medium according to this example.

[Composition of Coating Formulation 1]

| | |
|---|---|
| Fine particles of thermoplastic resin: Porous nylon particles (Orgasol 3501EXD NAT, trade name, product of Elf Atochem S. A.; average particle size: 12 μm) | 100 parts |
| Binder: Ethylene-acrylic acid copolymer emulsion (Hytec E-8778, trade name, product of Toho Chemical Industry Co., Ltd., solid content: 25%) | 240 parts |
| Water: | 100 parts. |

In this example, an ink-jet printer B, which will be described subsequently, was used as a recording apparatus for water-based inks.

EXAMPLE 2

Filter paper (No. 5, trade name, product of Toyo Filter Paper Co., Ltd.) was used as an ink vehicle-absorbing layer which also functions as a support for an image-transfer medium. The ink vehicle-absorbing layer was subjected to a release treatment (about 1 g/m$^2$) using a releasing agent composed of silicone TPR6712, trade name, and catalyst CM670, trade name (both, products of Toshiba Silicone Co., Ltd.) to form a separating layer. The absorption coefficient Ka of the ink vehicle-absorbing layer, on which the separating layer had been formed, was 68.

A coating formulation for a coloring material-retaining layer (Coating Formulation 2) having the following composition was then applied by a Meyer bar to the surface of the ink vehicle-absorbing layer, on which the separating layer had been formed by the release treatment. Thereafter, the coating formulation thus-applied was dried in an oven preset at 80° C. to form a coloring material-retaining layer having a thickness of about 60 μm, thereby obtaining an image-transfer medium according to this example.

[Composition of Coating Formulation 2]

| | |
|---|---|
| Fine particles of thermoplastic resin: Ethylene-vinyl acetate copolymer emulsion (Chemipearl V-300, trade name, product of Mitsui Petrochemical Industries, Ltd., average particle size: 6 μm, solid content: 40%) | 250 parts |
| Binder: Urethane polymer emulsion (Takelac W-635C, trade name, product of Takeda Chemical Industries, Ltd., solid content: 35%) | 30 parts |
| Cationic resin: Acrylic cationic resin solution (EL Polymer NWS-16, trade name, product of Shin-Nakamura Chemical Co., Ltd., solid content: 35%). | 30 parts |

EXAMPLE 3

A polyethylene terephthalate film (Q-80D, trade name, product of Toray Industries, Inc., 100 μm thick) was used as a base material, and the surface thereof was coated with a coating formulation for ink vehicle-absorbing layer (Coating Formulation 3) having the following composition, in which a releasing agent was contained, by a Meyer bar. Thereafter, the coating formulation thus-coated was dried in an oven preset at 100° C. to form an ink vehicle-absorbing layer having a thickness of about 10 g/m$^2$ in terms of coating weight. The absorption coefficient Ka of the ink vehicle-absorbing layer containing the releasing agent was 3.

The same coating formulation for a coloring material-retaining layer (Coating Formulation 1) as that used in Example 1 was then applied by a Meyer bar to the ink vehicle-absorbing layer thus formed. Thereafter, the coating formulation thus-applied was dried in an oven preset at 80° C. to form a coloring material-retaining layer having a thickness of about 40 μm, thereby obtaining an image-transfer medium according to this example.

[Composition of Coating Formulation 3]

| | |
|---|---|
| Acetal-modified polyvinyl alcohol solution (KX-1, trade name, product of Sekisui Chemical Co., Ltd., solid content: 8%) | 100 parts |
| Fine particles of silicone resin (Tospearl 3120, trade name, product of Toshiba Silicone Co., Ltd.) | 1.5 parts |
| Mixed solution of water/isopropyl alcohol (1/1 weight ratio) | 30 parts. |

EXAMPLE 4

Release paper was used as a layer functioning as a support for an image-transfer medium and also functioning as an ink vehicle-absorbing layer. ST60 OKT-T (trade name, product of Lintec Corporation) was used as the release paper in this case. The surface of the release paper on the side functioning as the ink vehicle-absorbing layer, i.e., a surface subjected to no filling and releasing treatment, was subjected to a release treatment in the following manner to form a separating layer. Namely, a polyethylene emulsion (Chemipearl W-400, trade name, product of Mitsui Petrochemical Industries, Ltd., average particle size: 6 μm, solid content: 40%) was applied and then dried in an oven preset at 70° C. to form a separating layer having a thickness of about 20 g/m$^2$ in terms of coating weight, thereby conducting the release treatment. The absorption coefficient Ka of the ink vehicle-absorbing layer, on which the separating layer had been formed, was 1.

A coating formulation for a coloring material-retaining layer (Coating Formulation 4) having the following composition was then applied by a Meyer bar to the surface of the ink vehicle-absorbing layer, on which the release treatment had been performed, and was dried in an oven preset at 80° C. to form a coloring material-retaining layer having a thickness of about 50 μm, thereby obtaining an image-transfer medium according to this example.

[Composition of Coating Formulation 4]

| | |
|---|---|
| Fine particles of thermoplastic resin: Nylon particles (VESTAMELT 430 P1, trade name, product of Daicel Chemical Industries, Ltd., average particle size: 50 μm) | 100 parts |
| Binder: Urethane polymer emulsion (Takelac W-635C, trade name, product of Takeda Chemical Industries, Ltd., solid content: 35%) | 60 parts |
| Inorganic particles: Alumina (AKP-15, trade name, product of Sumitomo Chemical, Co., Ltd.) | 3 parts |
| Water: | 30 parts. |

EXAMPLE 5

Release paper (ST60 OKT-T, trade name, product of Lintec Corporation) functioning as a support for an image-transfer medium and also functioning as an ink vehicle-absorbing layer was used like Example 4. The surface of the release paper on the side functioning as the ink vehicle-absorbing layer was subjected to a release treatment in the following manner to form a separating layer. Namely, a polyethylene emulsion (Chemipearl W-400, trade name, product of Mitsui Petrochemical Industries, Ltd., average particle size: 6 μm, solid content: 40%) was applied and then dried in an oven preset at 70° C. to form a separating layer having a thickness of about 20 g/m$^2$ in terms of coating weight, thereby conducting the release treatment. The absorption coefficient Ka of the ink vehicle-absorbing layer, on which the separating layer had been formed, was 1.

A coating formulation for a coloring material-retaining layer (Coating Formulation 5) having the following composition was then applied by a Meyer bar to the surface of the ink vehicle-absorbing layer, on which the release treatment had been performed, and was dried in an oven preset at 80° C. to form a coloring material-retaining layer having a thickness of about 40 μm, thereby obtaining an image-transfer medium according to this example.

[Composition of Coating Formulation 5]

| | |
|---|---|
| Fine particles of thermoplastic resin: Nylon particles (VESTAMELT 431 P1, trade name, product of Daicel Chemical Industries, Ltd., average particle size: 50 μm) | 100 parts |
| Binder: Urethane polymer emulsion (Takelac W-635C, trade name, product of Takeda Chemical Industries, Ltd., solid content: 35%) | 60 parts |
| Inorganic particles: Silica (Mizukasil P-78A, trade name, product of Mizusawa Industrial Chemicals, Ltd., average particle size: 3 μm) | 3 parts |
| Cationic resin: Acrylic cationic resin solution (EL Polymer NWS-16, trade name, product of Shin-Nakamura Chemical Co., Ltd., solid content: 35%) | 30 parts |
| Water: | 30 parts. |

EXAMPLE 6

Release paper (ST60 OKT-T, trade name, product of Lintec Corporation) functioning as a support for an image-transfer medium and also functioning as an ink vehicle-absorbing layer was used like in Example 4. The surface of the release paper on the side functioning as the ink vehicle-absorbing layer was subjected to a release treatment. Namely, a polyethylene emulsion (Chemipearl W-400, trade name, product of Mitsui Petrochemical Industries, Ltd., average particle size: 6 μm, solid content: 40%) was applied and then dried in an oven preset at 70° C. to form a separating layer having a thickness of about 20 g/m$^2$ in terms of coating weight, thereby conducting the release treatment. The absorption coefficient Ka of the ink vehicle-absorbing layer, on which the separating layer had been formed, was 1.

A coating formulation for a coloring material-retaining layer (Coating Formulation 6) having the following composition was then applied by a Meyer bar to the surface of the ink vehicle-absorbing layer, on which the release treatment had been performed, and was dried in an oven preset at 80° C. to form a coloring material-retaining layer having a thickness of about 30 μm, thereby obtaining an image-transfer medium according to this example.

[Composition of Coating Formulation 6]

| | |
|---|---|
| Fine particles of thermoplastic resin: Porous nylon particles (Orgasol 3501EXD NAT, trade name, product of Elf Atochem S. A.; average particle size: 12 μm) | 100 parts |
| Binder: Ethylene-acrylic acid copolymer emulsion (Hytec E-8778, trade name, product of Toho Chemical Industry Co., Ltd., solid content: 25%) | 360 parts |
| Binder: Urethane polymer emulsion (Takelac W-635C, trade name, product of Takeda Chemical Industries, Ltd., solid content: 35%) | 30 parts |
| Inorganic particles: Silica (Mizukasil P-78A, trade name, product of Mizusawa Industrial Chemicals, Ltd., average particle size: 3 μm) | 4 parts |
| Cationic resin: Acrylic cationic resin solution (EL Polymer NWS-16, trade name, product of Shin-Nakamura Chemical Co., Ltd., solid content: 35%) | 30 parts |
| Surfactant: Fluorine-containing surfactant solution (Surflon S-131, trade name, product of Seimi Chemical Co., Ltd.; solid content: 30%) | 8 parts |
| Plasticizer: N-Ethyl-o,p-toluenesulfonamide (Topcizer No. 3, trade name, product of Fuji Amide Chemical Co., Ltd.) | 20 parts |
| Isopropyl alcohol | 300 parts. |

COMPARATIVE EXAMPLE 1

A comparative image-transfer medium was obtained in the same manner as in Example 1 except that the ink vehicle-absorbing layer (ink-receiving layer) was subjected to no release treatment.

COMPARATIVE EXAMPLE 2

A polyethylene terephthalate film (Q-80D, trade name, product of Toray Industries, Inc., 100 μm thick) was used as a base material, and was subjected to a release treatment (about 1 g/m$^2$). In this case, the same releasing agent (silicone TPR6712, trade name; catalyst CM670, trade name; products of Toshiba Silicone Co., Ltd.) as that used in Example 1 was used. The absorption coefficient Ka of the ink vehicle-absorbing layer, on which the separating layer had been formed, was lower than 0.1.

A coating formulation for a transfer layer (Coating Formulation 7) having the following composition was then applied by a Meyer bar to the surface of the base material, on which the release treatment had been performed, and was dried in an oven preset at 80° C. to form a transfer layer having a thickness of about 65 g/m$^2$ in terms of dry coating weight, thereby obtaining an image-transfer medium according to this Comparative Example.

[Composition of Coating Formulation 7]

| | |
|---|---|
| Fine particles of thermoplastic resin: Polyester resin particles (Nichigo Polyester MOP835F, trade name, product of The Nippon Synthetic Chemical Industry Co., Ltd.) | 100 parts |
| Binder: Aqueous ethylene-vinyl acetate copolymer resin (Pinlex OM-4000, trade name, product of Kuraray Co., Ltd.) | 25 parts |
| Inorganic particles: Silica (Nipsil HD, trade name, product of Nippon Silica Industrial Co., Ltd.) | 15 parts |
| Water: | 100 parts. |

[Evaluation]

Printing (mirror-image printing) was conducted on the thus-produced image-transfer media of Examples 1 to 6, and Comparative Examples 1 and 2 in accordance with a back printing film mode by means of an ink-jet color printer. With respect to the ink-jet color printers used at this time, DJ-694c (trade name, manufactured by Hewlett Packard Co.), Apparatus B, was used in Example 1, while BJC-600J (trade name, manufactured by Canon Inc.), Apparatus A, was used in other cases, thereby conducting printing.

Using each of the image-transfer media, on which the image had been formed, the side of the coloring material-retaining layer of the image-transfer medium, on which the image had been formed, was placed on a 100% cotton T-shirt (BEEFY, trade name; product of Hanes Co.). The coloring material-retaining layer was transferred to the T-shirt by heating it by means of a heat transfer machine from the base material side opposite to the coloring material-retaining layer of the image-transfer medium. The conditions for thermal transfer printing at this time were as follows:

surface temperature of hot plate: 180° C., transfer pressure: 80 g/cm$^2$, and transfer time: 15 seconds.

After the image-transfer medium was fully cooled, the support composed of the ink vehicle-absorbing layer or the base material provided with the ink vehicle-absorbing layer was released and separated from the coloring material-retaining layer to obtain a printed article (transfer-printed cloth) with a transferred image formed on the T-shirt as a transfer-printing medium.

Each transfer-printed cloth thus obtained was evaluated as to the following items in accordance with the following respective evaluation methods.

(1) Suitability for Ink-et:

a) Optical Density of Image:

As a print sample on a coloring material-retaining layer of an image-transfer medium, a black print patch of a 100% print density, in which dots were formed in the whole pixels, was formed on each image-transfer medium. Thereafter, the print sample was transfer-printed on a T-shirt in accordance with the process described above. The optical density of the transferred black print sample was measured by means of a densitometer (Macbeth RD-918, trade name, manufactured by Macbeth Co.).

b) Image Quality:

Two patches of different colors were printed adjoiningly to each other on each image-transfer medium, whereby evaluation was made by whether bleeding occurred or not at the boundary between the two colors. More specifically, patch print samples were adjoiningly formed with two colors among yellow, cyan, blue and red in 100 t print density at all pixels to visually observe them as to whether bleeding occurred or not at boundaries between the respective adjacent colors, thereby evaluating the image-transfer medium as to image quality in accordance with the following 4-rank standard:

A: No bleeding occurred at boundaries among all the colors;

B: Bleeding occurred only at the boundary between the secondary colors (between blue and red);

C: Bleeding occurred even at the boundary between the secondary color and the primary color (between blue and cyan); and D: Bleeding occurred at boundaries among all the colors.

(2) Ease of Transfer Printing:

Each transfer-printed T-shirt obtained in the above-described manner was washed by hand for 2 minutes in tepid water of 30° C. and air dried and thereafter, transfer time (second) required for becoming free from fall-off of the transfer-printed portion from the T-shirt, lifting or peeling was measured, thereby evaluating the image-transfer medium as to ease of transfer printing.

(3) Maintenance of Hand:

The bending resistance (mm) of the transferred image portion of each transfer-printed cloth with a transferred image formed on a T-shirt obtained in the above-described manner was measured in accordance with Method A (45° cantilever method) prescribed in Item 6. 19. 1. of JIS L 1096. A difference between this bending resistance and that of the transfer-printing medium (T-shirt) before the transfer printing as measured by the same method was regarded as the maintenance of hand in the present invention. In this case, the maintenance of hand is better as the difference in bending resistance is smaller.

TABLE 1

| | Evaluation results | | | | |
|---|---|---|---|---|---|
| | Suitability for ink-Jet | | Ease of | | Support material; release |
| | Optical density of image | Image quality | transfer printing (sec) | Maintenance of hand (mm) | treatment; thickness of coloring material-retaining layer (transfer layer) |
| Ex. 1 | 1.51 | A | 15 | 36 | Coated paper for ink-jet; formed a separating layer (1 g/m$^2$); |

TABLE 1-continued

| | Evaluation results | | | | |
|---|---|---|---|---|---|
| | Suitability for ink-Jet | | Ease of | | Support material; release |
| | Optical density of image | Image quality | transfer printing (sec) | Maintenance of hand (mm) | treatment; thickness of coloring material-retaining layer (transfer layer) |
| | | | | | thickness of separating layer: 40 μm |
| Ex. 2 | 1.44 | A | 10 | 22 | Filter paper; formed a separating layer (1 g/m$^2$); thickness of separating layer: 60 μm |
| Ex. 3 | 1.47 | A | 15 | 37 | PET film; contained a separating agent in absorbing layer; thickness of separating layer: 40 μm |
| Ex. 4 | 1.41 | A | 13 | 35 | Release paper; formed a separating layer (20 g/m$^2$); thickness of separating layer: 50 μm |
| Ex. 5 | 1.49 | A | 14 | 30 | Release paper; formed a separating layer (20 g/m$^2$); thickness of separating layer: 40 μm |
| Ex. 6 | 1.43 | A | 12 | 30 | Release paper; formed a separating layer (20 g/m$^2$); thickness of separating layer: 30 μm |
| Comp. Ex. 1 | Immeasurable | A | Not released | Immeasurable | Not subjected to release treatment |
| Comp. Ex. 2 | 1.50 | B | 15 | 35 | having no ink vehicle-absorbing layer; transfer layer: 65 g/m$^2$ |

According to the present invention, as described above, there can be provided image-transfer media which retain excellent suitability for ink-jet printing, permit the formation of a high-quality image having a high optical density without causing any bleeding and have excellent transferability to transfer-printing media, and by which anyone can form a transferred image with ease, and the transferred image formed on a transfer-printing medium such as a cloth does not impair the hand inherent in the transfer-printing medium, a production process of a transferred image using such an image-transfer medium, and cloths with a transferred image formed thereon by the production process.

What is claimed is:

1. An image-transfer medium, comprising an ink vehicle-absorbing layer and a coloring material-retaining layer, wherein the ink vehicle-absorbing layer has a porous structure, wherein a porous separating layer is formed by subjecting the ink vehicle-absorbing layer to a release treatment of impregnating the ink vehicle-absorbing layer with a solution of a releasing agent, wherein the releasing agent is a silicone resin, wherein the absorption coefficient Ka of the ink vehicle-absorbing layer subjected to the release treatment is not less than 1, and wherein a liquid medium of an ink migrates into the ink vehicle-absorbing layer through the porous separating layer.

2. The image-transfer medium according to any one of claim 1, wherein the coloring material-retaining layer comprises fine particles of a thermoplastic resin and a binder.

3. The image-transfer medium according to claim 2, wherein the binder is a thermoplastic resin and/or a cationically modified product thereof.

4. The image-transfer medium according to claim 2, wherein a cationic resin is contained in the coloring material-retaining layer.

5. The image-transfer medium according to claim 2, wherein inorganic particles are contained in the coloring material-retaining layer.

6. A process for producing a transferred image, comprising the steps of:

forming an image on the coloring material-retaining layer of the image-transfer medium according to claim 1 in accordance with an ink-jet printing system; and overlapping the image-transfer medium, on which the image has been formed, and a transfer-printing medium on each other to transfer the coloring material-retaining layer to the transfer-printing medium.

* * * * *

UNITED STATES PATENT AND TRADEMARK OFFICE

CERTIFICATE OF CORRECTION

PATENT NO. : 6,871,950 B2
APPLICATION NO. : 09/248271
DATED : March 29, 2005
INVENTOR(S) : Masahiko Higuma et al.

It is certified that error appears in the above-identified patent and that said Letters Patent is hereby corrected as shown below:

ON THE COVER PAGE
Item (57), Abstract, line 3, "and" should read --and a--.

COLUMN 1
Line 30, "by," should read --by--.

COLUMN 3
Line 57, "sheet-or" should read --sheet or --.

COLUMN 5
Line 65, "0.25" should be deleted.

COLUMN 6
Line 39, "20 g/$M^2$," should read --20 g/$m^2$,--.

COLUMN 10
Line 10, "N-methyiacrylamide," should read --N-methylacrylamide--.

COLUMN 12
Line 13, "layer-of" should read --layer of--.
Line 62, "wean" should read --mean--.

COLUMN 18
Line 1, "Ink-et:" should read --Ink-jet:--.
Line 19, "100 t" should read --100%--.
Table 1, "ink-Jet" should read --ink-jet--.

COLUMN 19
Table 1-continued, "ink-Jet" should read --ink-jet--.

UNITED STATES PATENT AND TRADEMARK OFFICE

CERTIFICATE OF CORRECTION

PATENT NO. : 6,871,950 B2
APPLICATION NO. : 09/248271
DATED : March 29, 2005
INVENTOR(S) : Masahiko Higuma et al.

It is certified that error appears in the above-identified patent and that said Letters Patent is hereby corrected as shown below:

COLUMN 20
Line 31, "any one of" should be deleted.

Signed and Sealed this

Twenty-sixth Day of September, 2006

JON W. DUDAS
*Director of the United States Patent and Trademark Office*